US008357215B2

(12) United States Patent
Russell et al.

(10) Patent No.: US 8,357,215 B2
(45) Date of Patent: Jan. 22, 2013

(54) METHOD AND APPARATUS OF PARTICULATE REMOVAL FROM GASIFIER COMPONENTS

(75) Inventors: Steven Craig Russell, Houston, TX (US); James Michael Storey, Houston, TX (US); Robert Henri Gauthier, Houston, TX (US)

(73) Assignee: General Electric Company, Schenectady, NY (US)

( * ) Notice: Subject to any disclaimer, the term of this patent is extended or adjusted under 35 U.S.C. 154(b) by 689 days.

(21) Appl. No.: 12/397,658

(22) Filed: Mar. 4, 2009

(65) Prior Publication Data

US 2010/0223847 A1 Sep. 9, 2010

(51) Int. Cl.
*C10J 3/82* (2006.01)
*F28G 7/00* (2006.01)

(52) U.S. Cl. ..... 48/87; 165/84; 165/95

(58) Field of Classification Search ..... 48/87; 122/379, 122/392; 165/84, 95
See application file for complete search history.

(56) References Cited

U.S. PATENT DOCUMENTS

| | | | | |
|---|---|---|---|---|
| 3,746,521 | A | 7/1973 | Giddings | |
| 4,478,608 | A * | 10/1984 | Dorling et al. | 48/210 |
| 4,859,214 | A * | 8/1989 | Segerstrom et al. | 48/197 R |
| 4,936,873 | A | 6/1990 | Richard | |
| 4,950,308 | A * | 8/1990 | Lang et al. | 48/62 R |
| 5,079,459 | A * | 1/1992 | Huston et al. | 310/15 |
| 5,287,915 | A * | 2/1994 | Liu et al. | 165/84 |
| 5,441,547 | A | 8/1995 | Durrfeld et al. | |
| 5,560,323 | A * | 10/1996 | Billings | 122/379 |
| 6,141,796 | A | 11/2000 | Cummings | |
| 2008/0041322 | A1 * | 2/2008 | Fry et al. | 122/379 |
| 2008/0271685 | A1 * | 11/2008 | Lupkes et al. | 122/396 |

FOREIGN PATENT DOCUMENTS

| | | |
|---|---|---|
| DE | 3808729 | 10/1989 |
| PL | 149012 B1 | 3/1987 |
| PL | 173329 B1 | 9/1994 |
| PL | 190794 | 1/2001 |
| ZA | 989759 A | 5/1999 |

OTHER PUBLICATIONS

Poland Search Report dated Apr. 15, 2010.

* cited by examiner

*Primary Examiner* — Jill Warden
*Assistant Examiner* — Joye L Woodard
(74) *Attorney, Agent, or Firm* — Cantor Colburn LLP

(57) ABSTRACT

Disclosed is a method of removing a particulate layer from a gasification system component including locating a shedding apparatus in operable communication with the gasification system component. A force is transmitted from the shedding apparatus into the gasification system component and the particulate layer is shed from the gasification system component as a result of the force. Further disclosed is a syngas cooler for a gasification system including a vessel and a plurality of thermal energy transfer platens located in the vessel. A shedding apparatus is in operable communication with the plurality of platens and is capable of shedding a particulate layer from the plurality of platens by transmitting a force to the plurality of platens. The apparatus includes a manifold disposed between the shedding apparatus and the plurality of platens and connected to the plurality of platens via one or more struts capable of distributing the force to the plurality of platens.

7 Claims, 14 Drawing Sheets

METHOD AND APPARATUS OF PARTICULATE REMOVAL FROM GASIFIER COMPONENTS

BACKGROUND OF THE INVENTION

The subject matter disclosed herein relates to gasification systems and processes. More particularly, the subject matter relates to removal of particulate layers from gasification system components.

Gasification is a process for the production of power, chemicals, and industrial gases from carbonaceous or hydrocarbon feedstocks such as coal, heavy oil, and petroleum coke. Gasification converts carbonaceous or hydrocarbon feedstocks into synthesis gas, also known as syngas, comprising primarily hydrogen and carbon monoxide. The resultant syngas is a feedstock for making useful organic compounds or can be used as a clean fuel to produce power.

In a typical gasification plant, a carbonaceous or hydrocarbon feedstock and molecular oxygen are contacted at high pressures within a partial oxidation reactor (gasifier). The feedstock and molecular oxygen react and form syngas. Non-gasifiable ash material and unconverted and/or incompletely converted feedstock are by products of the process and take essentially two forms: molten slag and smaller particles referred to as "fines". In some gasification plants, a syngas cooler is located downstream of the gasifier. The syngas, ash, slag and fines cool as they travel through the syngas cooler. A quench process cools and saturates the syngas near the exit of the syngas cooler. Alternatively, in gasification plants without syngas coolers, the quench is located near the exit of the gasifier. Further, additional cooling and/or gas clean-up components may be disposed downstream of the quench. During the cooling process, however, deposits of soot and ash, for example, form on interior surfaces of the syngas cooler, and/or the quench and additional cooling components. The deposits in the syngas cooler create many problems. For example, the deposit layer prevents efficient heat transfer from taking place, resulting in a reduction in steam production from the gasification process. Also, deposits may include corrosive species, thus the removal of the corrosive deposits would prolong the life of components of the syngas cooler, for example, heat transfer tubes. Further, deposits often break off from the interior of the syngas cooler under some operating conditions, for example, startup and shutdown. Such spontaneous liberation of large deposits often results in plugging of downstream components of the syngas cooler. Finally, falling deposits create a hazard for workers performing maintenance and/or repairs in the syngas cooler. Therefore it is desirable to remove the deposits at regular intervals prior to the deposits developing into a substantial size.

BRIEF DESCRIPTION OF THE INVENTION

According to one aspect of the invention, a method of removing a particulate layer from a gasification system component includes locating a shedding apparatus in operable communication with the gasification system component. A force is transmitted from the shedding apparatus into the gasification system component and the particulate layer is shed from the gasification system component as a result of the vibration.

According to another aspect of the invention, a syngas cooler for a gasification system includes a vessel and a plurality of thermal energy transfer platens located in the vessel. A shedding apparatus is in operable communication with the plurality of platens and is capable of shedding a particulate layer from the plurality of platens by transmitting a force to the plurality of platens.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
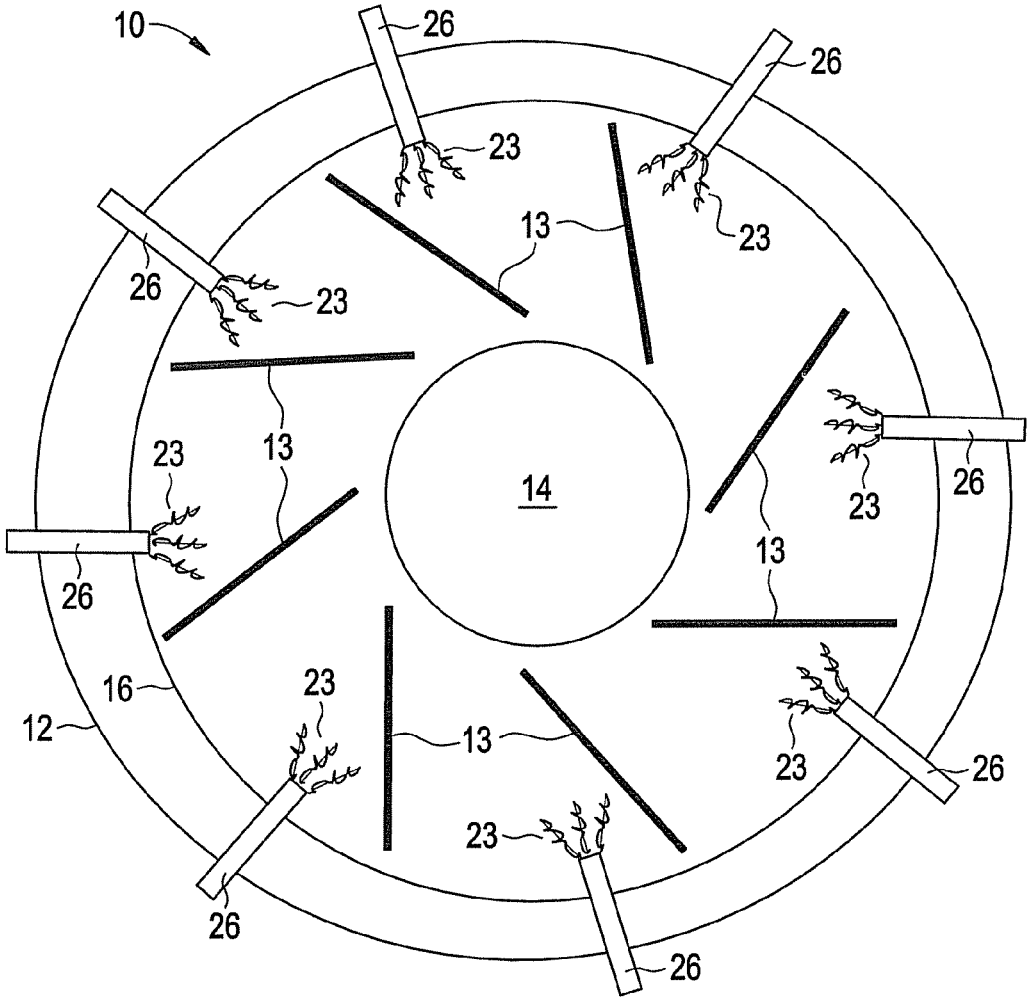
FIG. 1 is a plan view of an embodiment of a syngas cooler for a gasification system.
Figure 2:
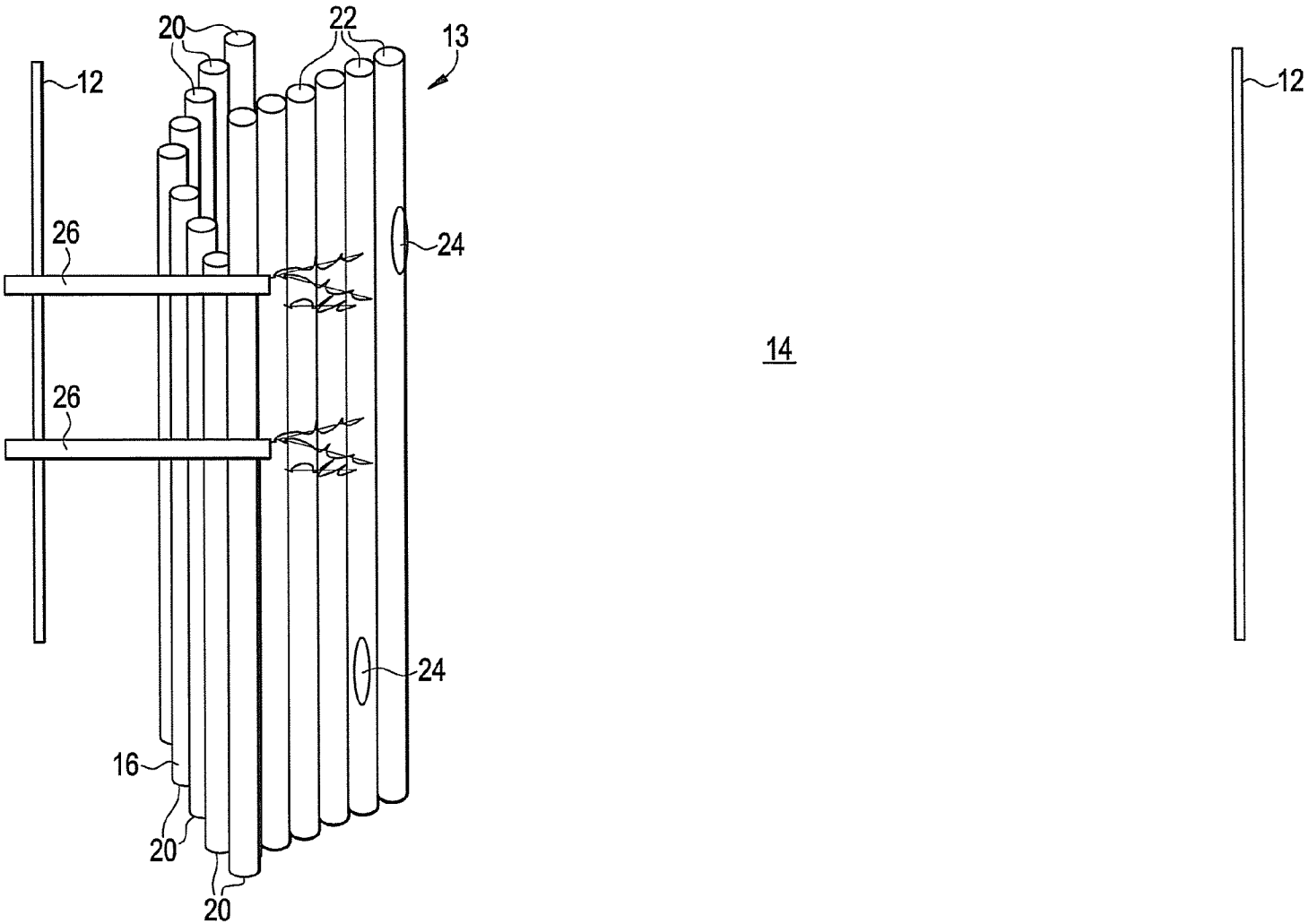
FIG. 2 is a cross-sectional view of the syngas cooler of FIG. 1.

Shown in FIG. 1 is an embodiment of a gasification system component, in this case a syngas cooler 10. The syngas cooler 10 comprises a vessel shell 12 which defines an outer surface of the syngas cooler 10. A plurality of internal components may be disposed inside of the vessel shell 12 in an interior 14 of the syngas cooler 10. Many of these components, including a tube cage 16 and one or more sets of platens 18, are configured and disposed to facilitate transfer of thermal energy from syngas in the syngas cooler 10 to the tube cage 16 and/or the platens 18. While eight sets of platens 18 are shown in FIG. 1, it is to be appreciated that other quantities of sets of platens 18, for example 10 or 12 sets of platens 18 may be arranged in the interior 14 of the syngas cooler 10. As shown in FIG. 2, the tube cage 16 comprises a plurality of individual cage tubes 20 and each set of platens 18 comprises a plurality of platen tubes 22. During operation of the syngas cooler 10, particulates in the syngas accumulate and build up creating layers 24 of particulates on, for example, heat exchange surface such as the platen tubes 22 and the cage tubes 20. The deposit layers 24 inhibit efficient thermal energy transfer from the syngas to the platen tubes 22 and the tube cages 20.

To periodically remove the layers 24, in some embodiments the syngas cooler 10 includes one or more sprayers 26, as shown in FIGS. 1 and 2. The sprayers 26 are disposed at the interior 14 of the syngas cooler 10. When the sprayers 26 are activated, a high pressure flow 28 of fluid, in some embodiments, water, is directed from the sprayers 26 toward the platen tubes 22, thereby removing the layers 24 therefrom. The flow 28 acts to remove the layers 24 by mechanically shearing the layers 24 from the platen tubes 22 and also by chemically dissolving the layers 24 in the flow 28. Further, because of a temperature differential between the flow 28 and the layers 24, when it impacts the layers 24 the flow 28 causes thermal contractions in the deposit layers 24 thus causing the layers 24 to fall off of the platen tubes 22. As shown in FIG. 2, the sprayers 26 may be arranged around a circumference of the interior 14, and as shown in FIG. 1, may also be arranged along a length of the interior 14. Further, in some embodiments, each sprayer 26 is capable of spraying in a predetermined pattern along the platen tubes 22 to increase the amount of platen tube 22 surface exposed to the flow 28. Alternatively, in some embodiments, the sprayers 26 are configured and disposed to spray solid projectiles, for example, ball bearings, of a desired size at the platen tubes 22 to remove the layers 24.

Figure 3:
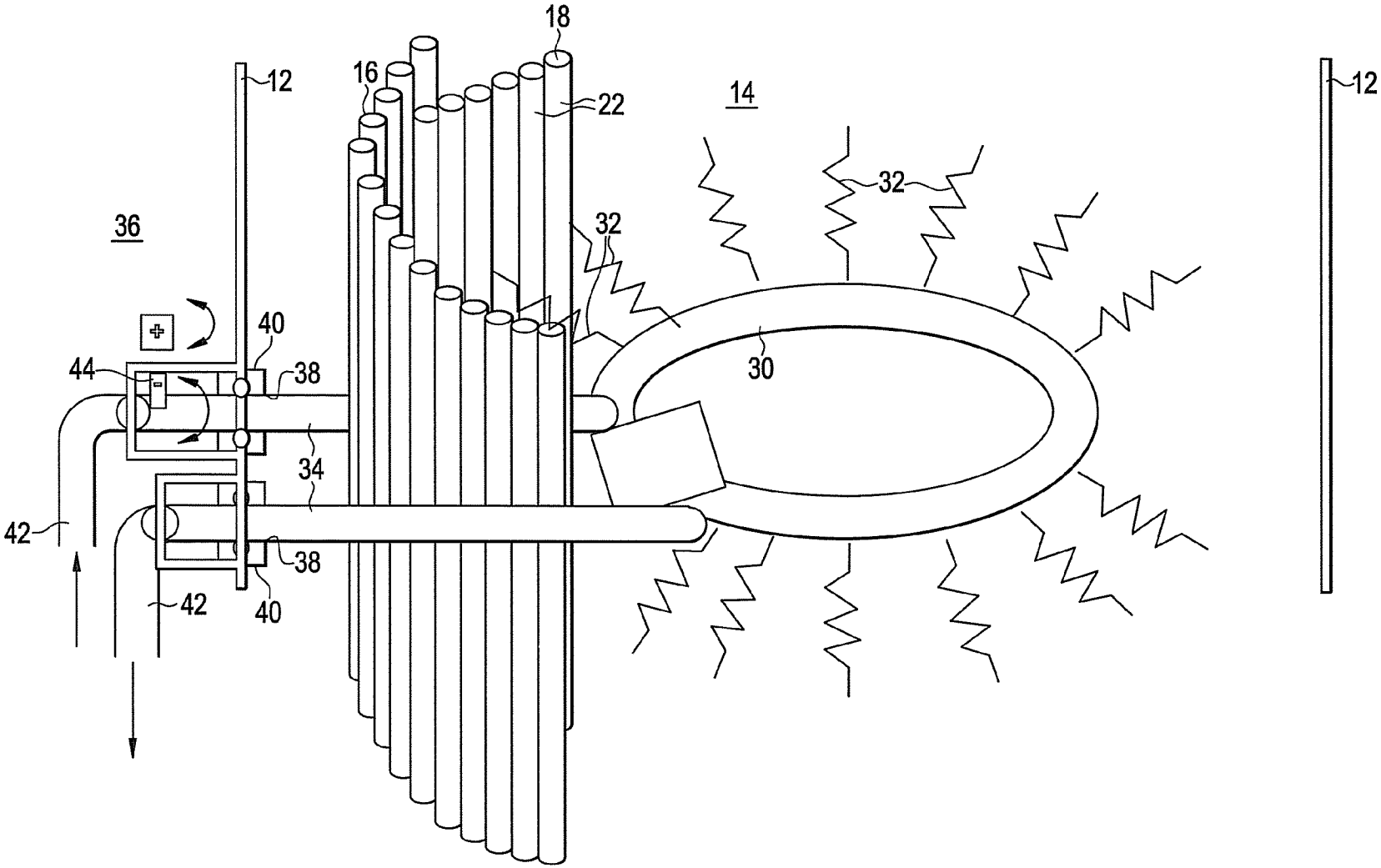
FIG. 3 is a cross-sectional view of another embodiment of a syngas cooler for a gasification system.
Figure 4:
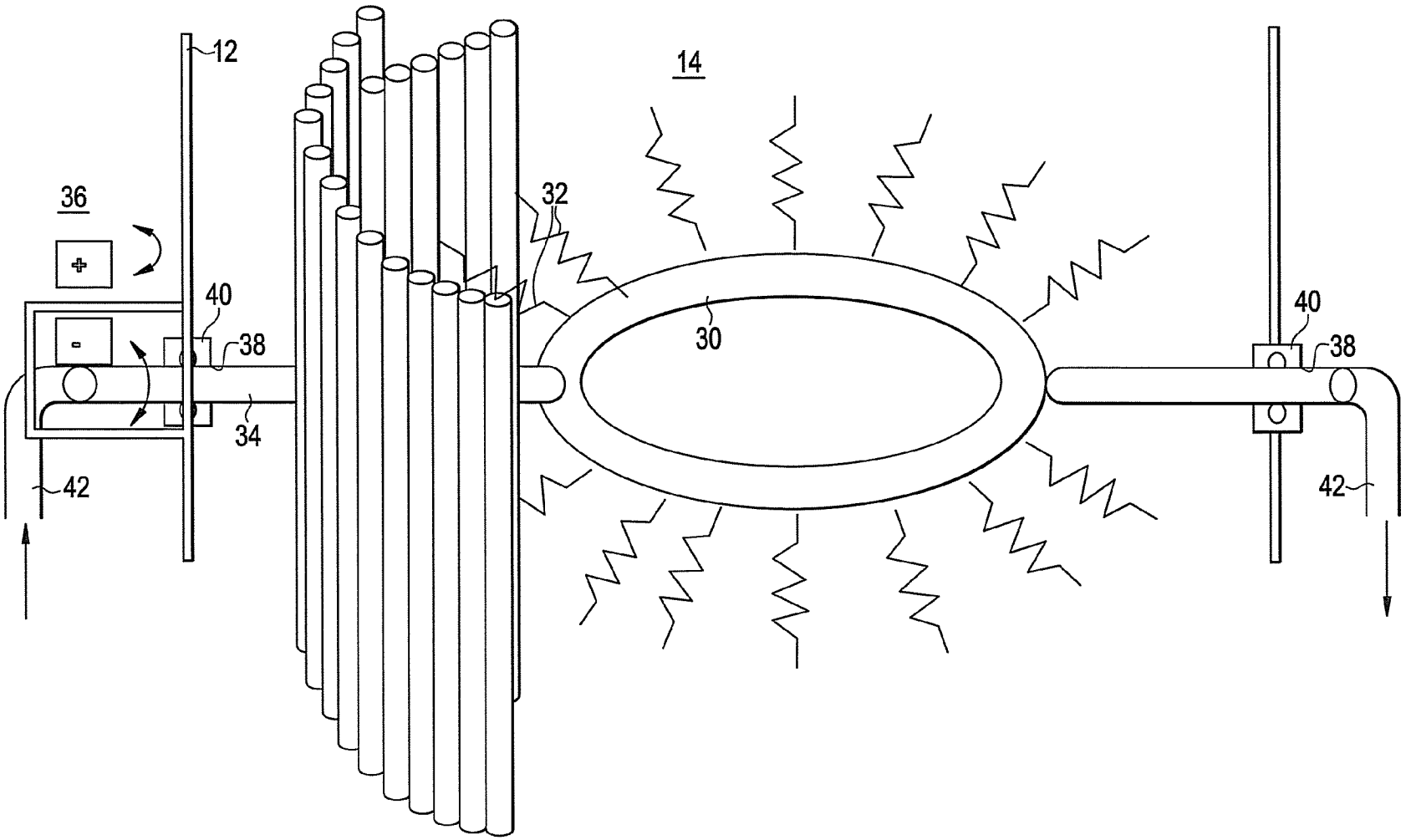
FIG. 4 is a cross-sectional view of another embodiment of the syngas cooler of FIG. 3.
Figure 5:
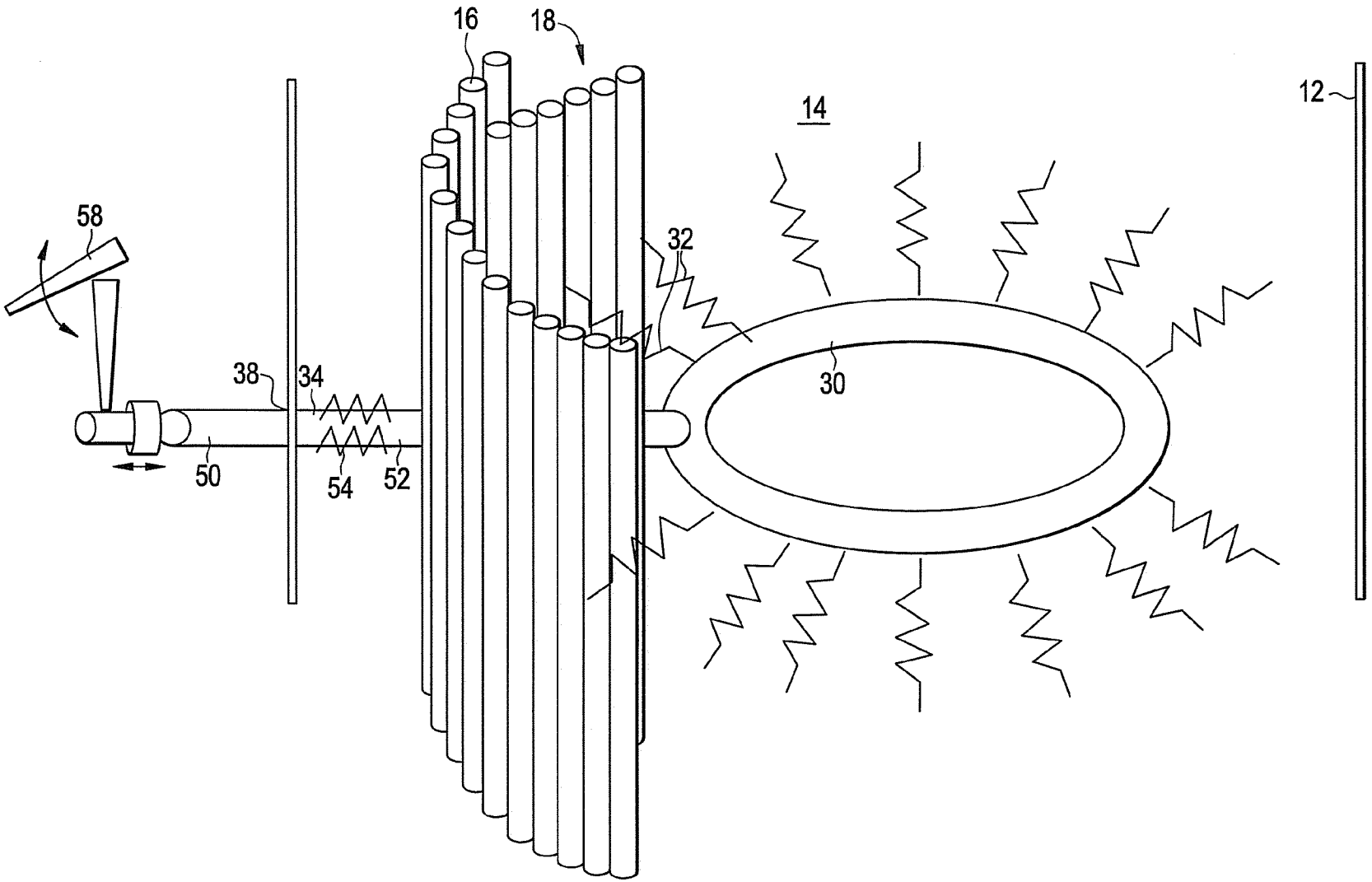
FIG. 5 is a cross-sectional view of an embodiment of a syngas cooler including a single support.
Figure 6:
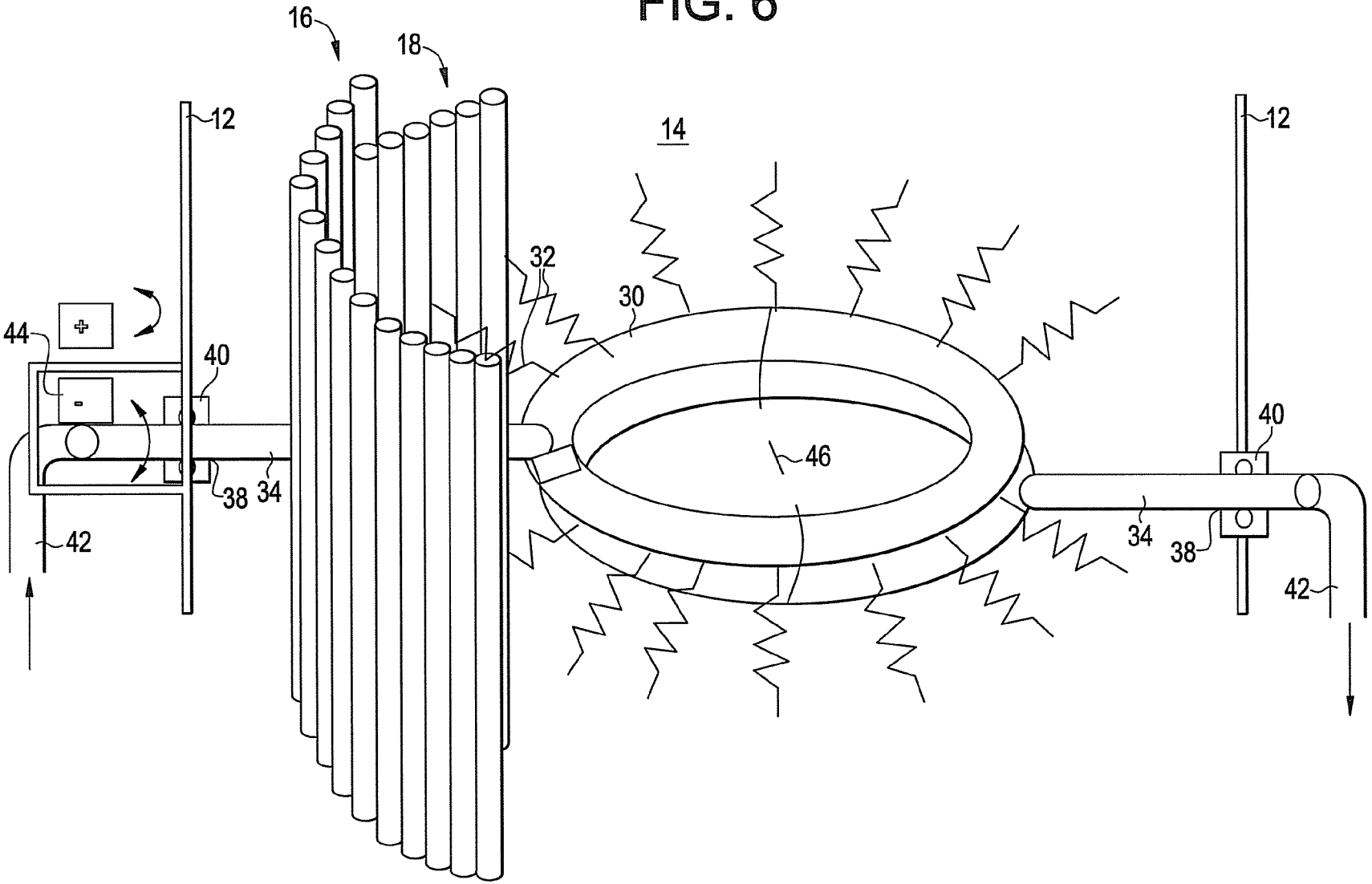
FIG. 6 is a cross-sectional view of an embodiment of a syngas cooler including a helical manifold.

In some embodiments, the means to remove layers 24 from the sets of platens 18 is a mechanical structure that causes a vibration of the platen tubes 22 sufficient to cause the layers 24 to be liberated from the platen tubes 22. For example, as shown in FIG. 3, a vibration manifold 30 is disposed in the interior 14 of the syngas cooler 10. The vibration manifold 30 is mechanically attached to the sets of platens 18 by one or more struts 32, which in some embodiments are springs. At least one support 34 extends through the vessel shell 12 from an exterior 36 of the syngas cooler 10 through a support opening 38. In some embodiments, the support opening 38 includes a ball bearing 40 arrangement at which the support 34 is disposed. In the embodiment of FIG. 3, the manifold 30 is substantially circular in shape, and two supports 34 are utilized and are disposed at substantially the same circumferential position in the vessel shell 12. It is to be appreciated that in other embodiments, as shown in FIG. 4, the supports 34 may be located at other relative circumferential locations, for example 180 degrees apart. Further, as shown in FIG. 5, a single support 34 may be utilized. Referring again to FIG. 3, flex hoses 42 are coupled to the supports 34 to provide a conduit for a flow of cooling fluid through the supports 34 and the manifold 30 to extend the useful life of the manifold 30 in the high temperature environment of the interior 14. In the embodiment of FIG. 3, a vibratory force is initiated by an activator, such as a mechanical crank 44. In some embodiments, the mechanical crank 44 is driven by a magnetic actuator comprising members of opposing polarity that urge rotation of the mechanical crank 44 without direct contact with the mechanical crank 44. Turning of the mechanical crank 44 initiates a rotation of the support 34, which induces a vibratory force in the manifold 30. The vibration of the manifold 30 is transmitted to the sets of platens 18 via the one or more struts 32 thus causing the platen tubes 22 to vibrate and cause the layers 24 to be removed from the platen tubes 22. While the manifold 30 shown in FIG. 3 is substantially circular in shape, as shown in FIG. 6, the manifold 30 may be helical in shape extending in at least one direction along a manifold axis 46. A helical manifold 30 allows for greater flexibility to improve the vibratory capacity of the manifold 30 and for the placements of additional struts 32 fixed to the platens 20 along a length of the platens 20.

Figure 7:
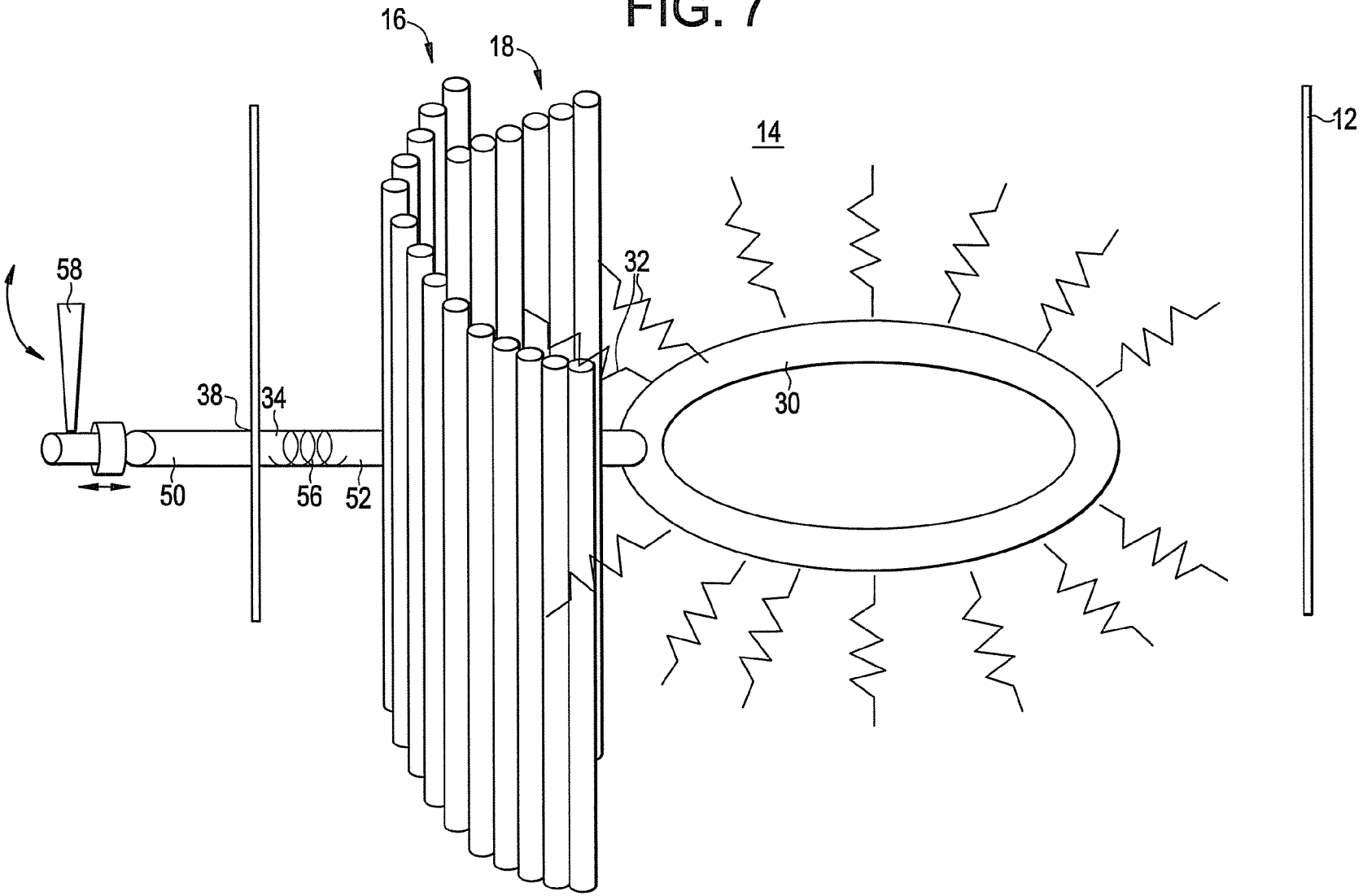
FIG. 7 is an alternative embodiment of the syngas cooler of FIG. 5.
Figure 8:
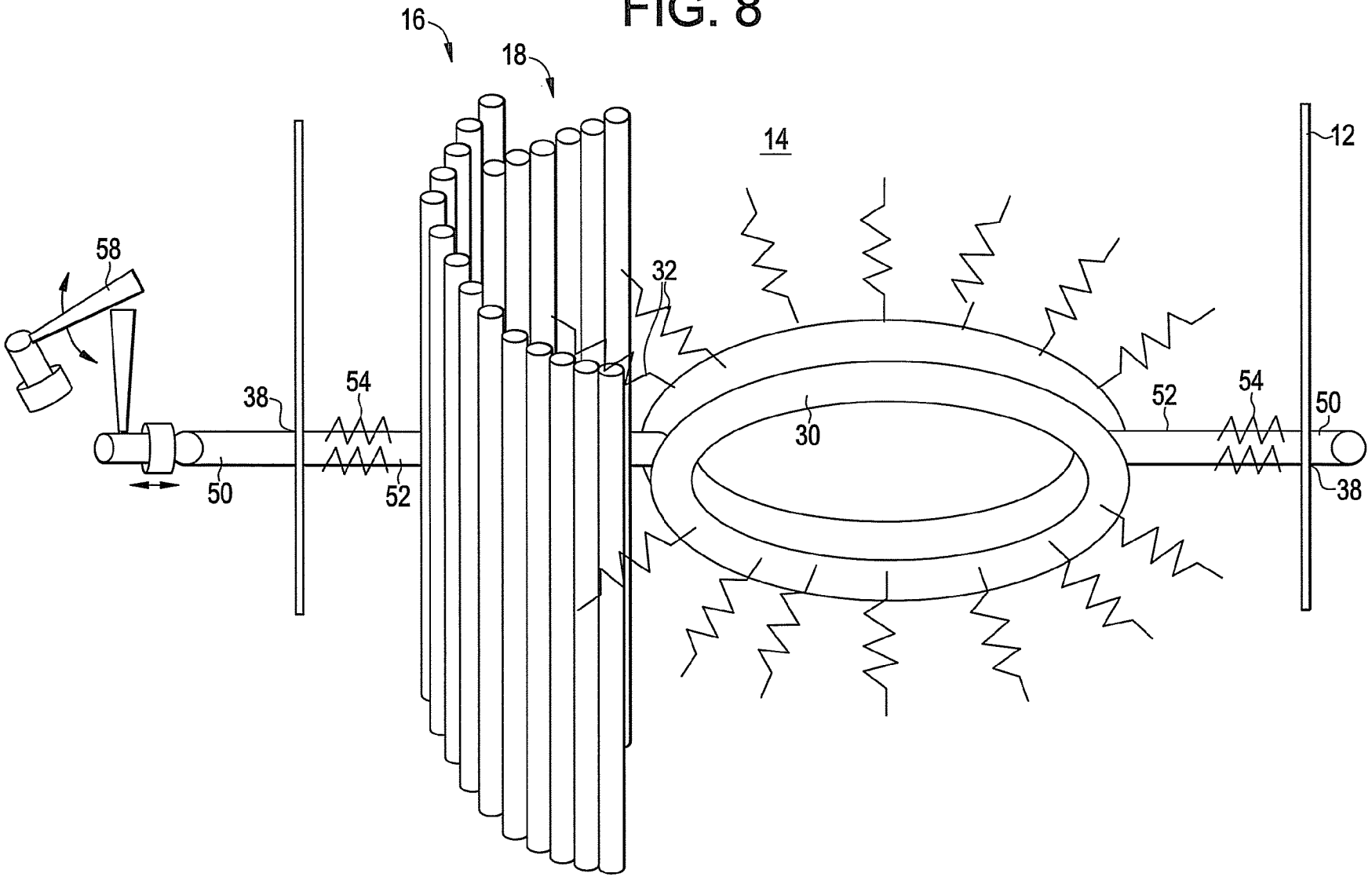
FIG. 8 is an alternative embodiment of the syngas cooler of FIG. 6.

Referring again to FIG. 5, in some embodiment the manifold 30 may be supported by a single support 34. The support 34 extends through vessel shell 12 and comprises an outer support 50 that extends through the vessel shell 12, and an inner support 52 that is affixed to the manifold 30. The outer support 50 and the inner support 52 are coupled to each other by, for example, a bellows coupling 54. In another embodiment, as shown in FIG. 7, the outer support 50 and inner support 52 are coupled to each other by a wound tube 56. In the embodiment of FIG. 5, the vibratory force is initiated by one of several means including a mechanical hammer or crank 58, an electrically or pneumatically-induced vibration, and/or by a fluid pulse through the outer support 50. The force is transmitted through the outer support 50 and the bellows coupling 54 to the manifold 30 via the inner support 52. The vibratory force is then transmitted through the one or more struts 32 to the platen tubes 22 to remove the layers 24. Referring now to FIG. 8, some embodiments may include a helical manifold 30 together with the bellows coupling 54. Further, the manifold 30 may be supported by more than one support 34, for example, two supports 34, each including a bellows coupling 54. Use of the bellows couplings 54 allows the outer supports 50 to remain in a fixed position while the inner supports 52 freely vibrate in response to the vibratory force.

Figure 9:
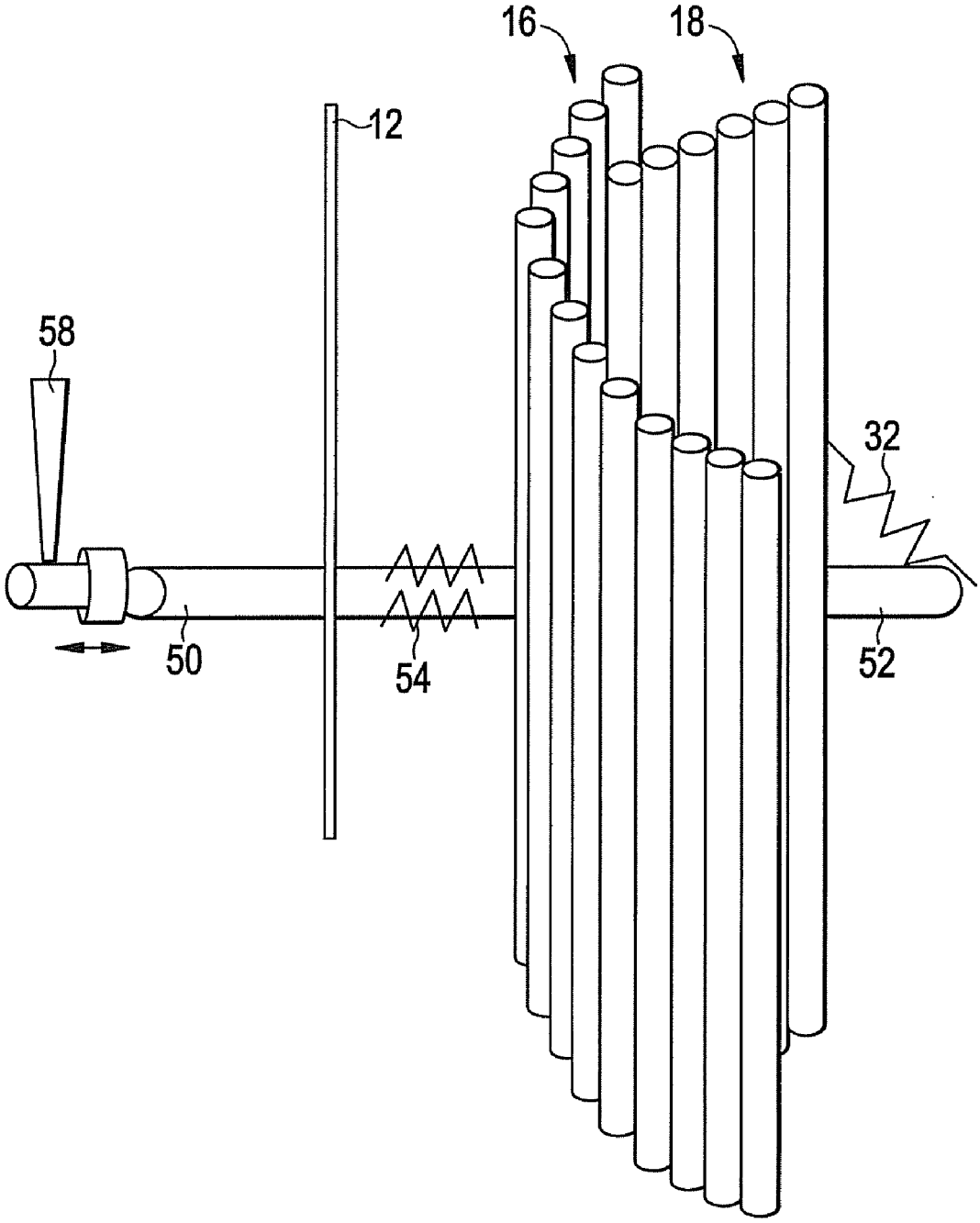
FIG. 9 is a cross-sectional view of yet another embodiment of a syngas cooler.
Figure 10:
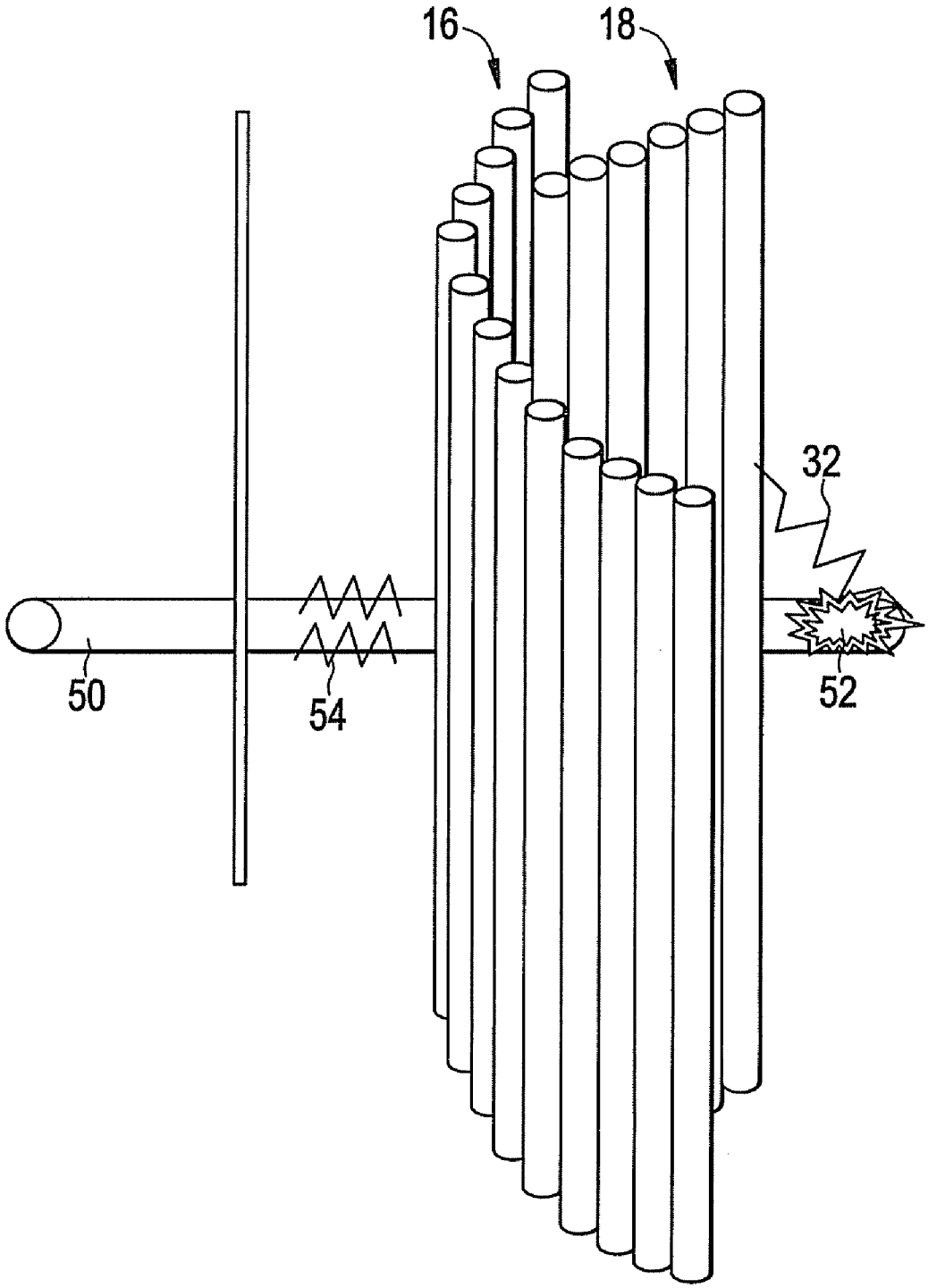
FIG. 10 is a cross-sectional view of still another embodiment of a syngas cooler.
Figure 11:
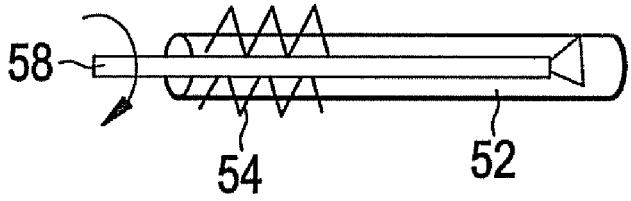
FIG. 11 is a detail view of an embodiment of the syngas cooler of FIG. 10 having a mechanical crank.
Figure 12:
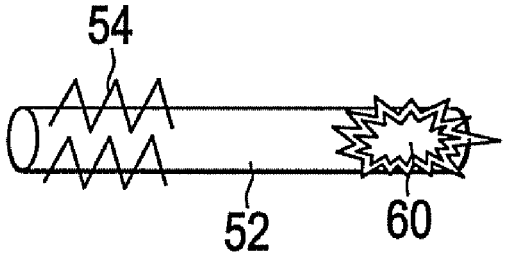
FIG. 12 is a detail view of an embodiment of the syngas cooler of FIG. 10 having an electrical or pneumatic actuator.
Figure 13:
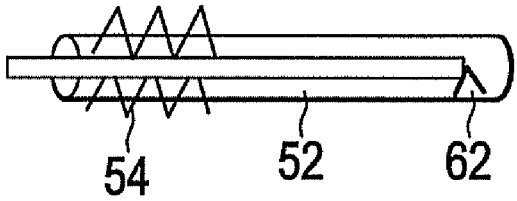
FIG. 13 is a detail view of an embodiment of the syngas cooler of FIG. 10 having a hydraulic jet.

Referring to FIG. 9, in some embodiments, the one or more struts 32 are coupled directly to the inner support 52 so the vibratory force is transmitted directly from the inner support 52 to the one or more struts 32. Referring to FIG. 10, the vibratory force may be initiated internally to the inner support 52. For example, referring to FIG. 11, the crank 58 may be disposed inside of the inner support 52 and when activated, initiates vibration of the inner support 52. As shown in FIG. 12, an electrical or pneumatic actuator 60 may be similarly disposed in the inner support 52 to initiate vibration thereof. Further, as shown in FIG. 13, a hydraulic jet 62 or water hammer disposed in the inner support 52 may initiate vibration of the inner support 52. Initiating the vibratory force in the inner support 52 increases efficient transmission of the vibratory force since it is not necessary to transmit the vibratory force to the inner support 52 via the outer support 50 and the bellows coupling 54.

Figure 14:
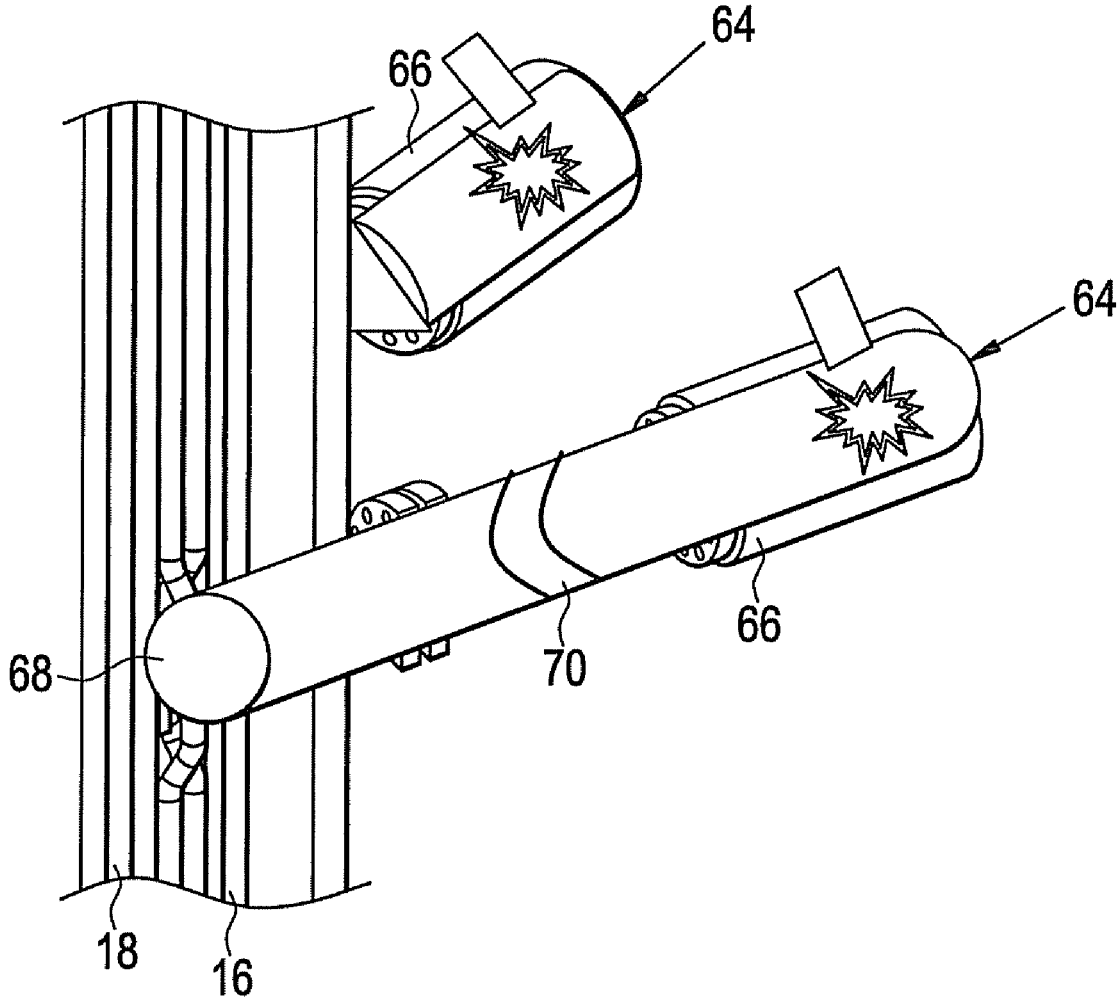
FIG. 14 is a cross-sectional view of an embodiment of a syngas cooler including a shock tube.
Figure 15:
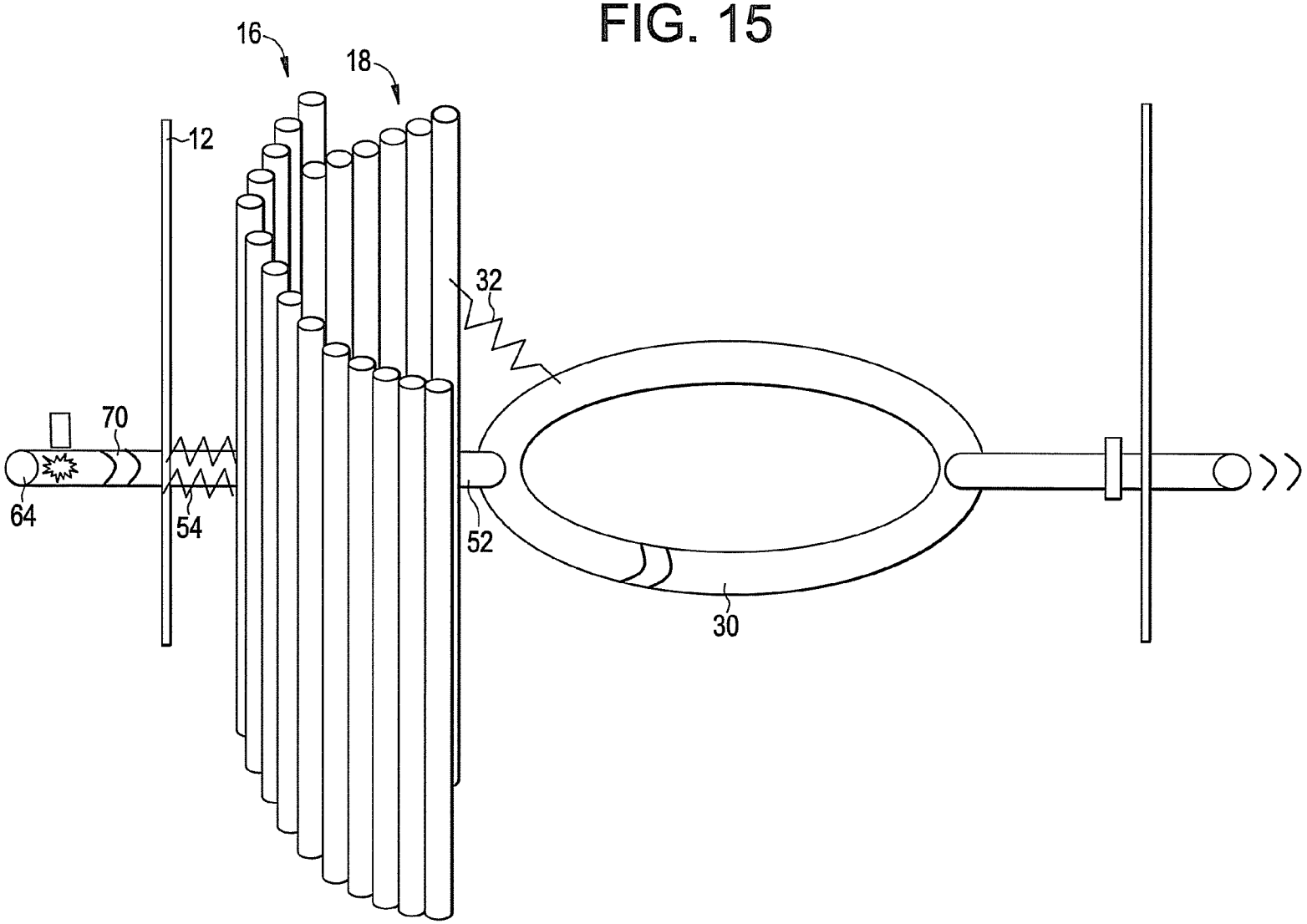
FIG. 15 is a cross-sectional view of another embodiment of the syngas cooler of FIG. 14.
Figure 16:
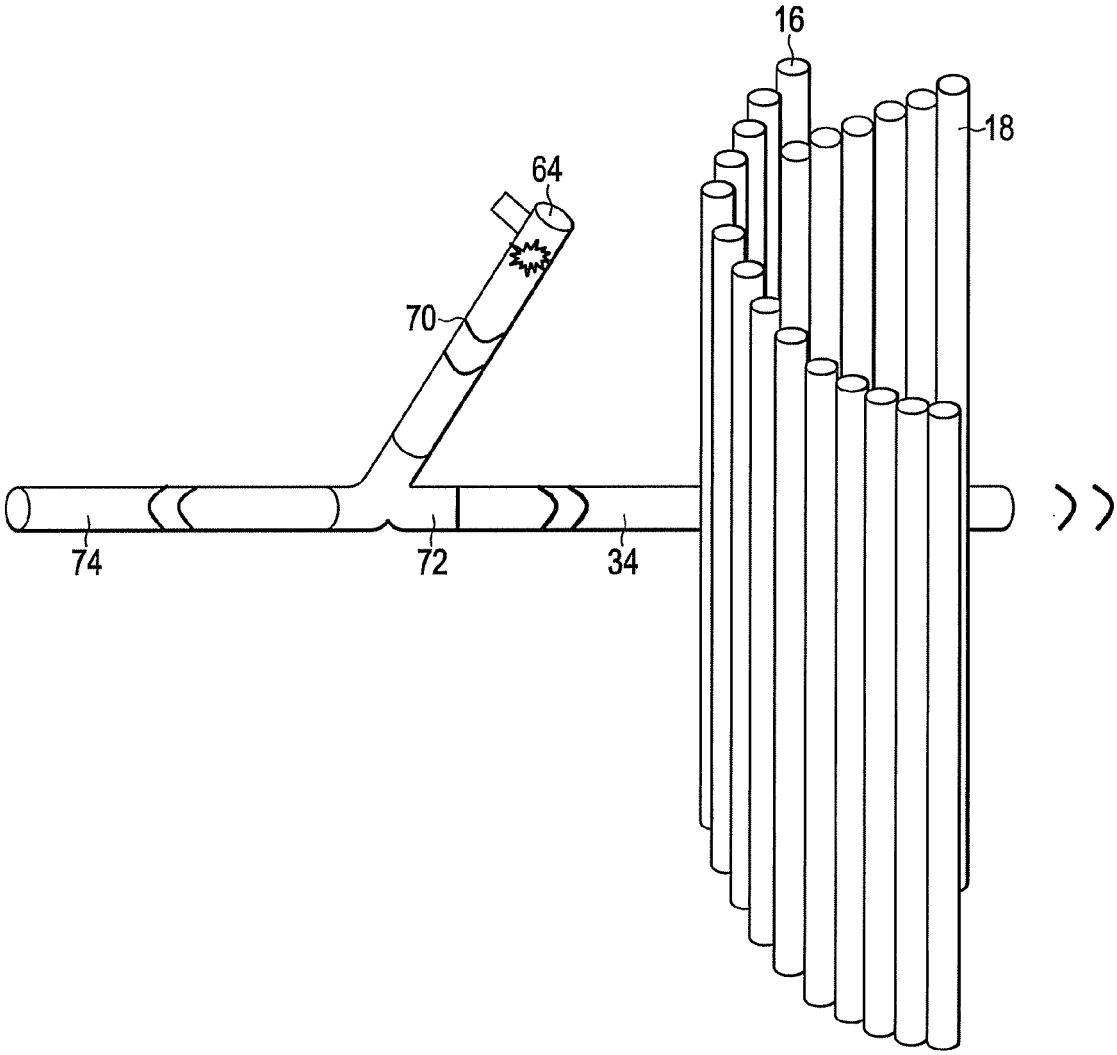
FIG. 16 is a cross-sectional view of yet another embodiment of the syngas cooler of FIG. 15.

Referring now to FIG. 14, some embodiments may utilize one or more shock tubes 64 to impart the vibratory force on the platens 20. Each shock tube 64 includes a shock tube body 66 that extends through an opening 68 in the tube cage 16. In one embodiment, since syngas is normally present in the shock tube 64, a quantity of oxygen is injected into the shock tube 64, which ignites the syngas fuel. The combustion process results in a shock wave 70 which imparts a force on the set of platens 18. The force initiates vibration of the set of platens 18 which removes the layers 24 from the platen tubes 22. As shown in FIG. 15, the one or more shock tubes 64 may be utilized to initiate vibration of a manifold 30. The manifold 30 is coupled to one or more struts 32 which transmit the vibratory force initiated by the one or more shock tubes 64 to the sets of platens 18. In this embodiment, flexibility in the manifold 30 design enables high tunability to achieve a desired amount of vibration. Further the manifold 30 serves to isolate the combustion process from the syngas in the syngas cooler 10. In other embodiments, as shown in FIG. 16, the shock tube 64 apparatus is isolated from the manifold 30 by a diaphragm 72 disposed in the one or more supports 34. When initiated, the shock tube 64 causes the diaphragm 72 to vibrate, which in turn transmits the vibration through a gas or fluid, for example, nitrogen, disposed in the support 34 and manifold 30. The shock tube 64 exhausts through an exhaust tube 74 so that exhaust gases are isolated from the remainder of the system.

It is to be appreciated that while the description of the embodiments herein are illustration in relation to a syngas cooler 10, application of the embodiments to other components, for example, a quench or other components of a gasification system, is contemplated within the present scope.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A syngas cooler for a gasification system comprising:

a vessel;

a plurality of thermal energy transfer platens disposed in the vessel;

a shedding apparatus in operable communication with the plurality of platens, the shedding apparatus capable of shedding a particulate layer from the plurality of platens by transmitting a force to the plurality of platens; and a manifold disposed between the shedding apparatus and the plurality of platens and connected to the plurality of platens via one or more struts capable of distributing the force to the plurality of platens.

2. The syngas cooler of claim 1 wherein the manifold has a helical configuration.

3. The syngas cooler of claim 1 wherein the shedding apparatus comprises one of a mechanical crank, an electrical generator, a pneumatic generator or a fluid pulse in operable communication with the plurality of platens.

4. The syngas cooler of claim 3 wherein the shedding apparatus is disposed inside of a tubular support extending into the vessel.

5. The syngas cooler of claim 1 wherein the shedding apparatus comprises at least one shock tube.

6. The syngas cooler of claim 1 wherein the shedding apparatus comprises a plurality of sprayers capable of directing a high pressure flow toward the plurality of platens.

7. The syngas cooler of claim 6 wherein the plurality of sprayers are configured to direct one of a fluid flow or a solid projectile flow.

* * * * *